US006358909B1

(12) United States Patent
Ochomogo et al.

(10) Patent No.: US 6,358,909 B1
(45) Date of Patent: Mar. 19, 2002

(54) SUSPOEMULSION SYSTEM FOR DELIVERY OF ACTIVES

(75) Inventors: Maria G. Ochomogo, Danville; Malcolm A. Deleo, Castro Valley; Hanneliese S. Selbach, Oakland, all of CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 09/594,666

(22) Filed: Jun. 15, 2000

Related U.S. Application Data

(63) Continuation-in-part of application No. 09/427,140, filed on Oct. 25, 1999, which is a continuation-in-part of application No. 08/731,653, filed on Oct. 17, 1996, now Pat. No. 5,972,876.

(60) Provisional application No. 60/139,904, filed on Jun. 17, 1999.

(51) Int. Cl.[7] ..... C11D 1/66; C11D 3/14; C11D 3/18; C11D 3/37

(52) U.S. Cl. ..... 510/417; 510/418; 510/382; 510/395; 510/397; 510/421; 510/470

(58) Field of Search ..... 510/417, 418, 510/382, 395, 397, 470, 421

(56) References Cited

U.S. PATENT DOCUMENTS

| | | | | |
|---|---|---|---|---|
| 4,853,026 A | | 8/1989 | Frisch | 71/86 |
| 4,929,383 A | | 5/1990 | Haendler | 252/187.26 |
| 5,074,905 A | | 12/1991 | Frisch | 71/120 |
| 5,075,029 A | | 12/1991 | Haendler | 252/186.25 |
| 5,096,711 A | | 3/1992 | Dookhith | 424/405 |
| 5,571,772 A | * | 11/1996 | Willms et al. | 504/106 |
| 5,589,448 A | | 12/1996 | Koerner | 510/284 |
| 5,789,364 A | | 8/1998 | Sells | 510/284 |
| 5,854,187 A | | 12/1998 | Blum | 510/197 |
| 5,912,220 A | | 6/1999 | Sramek | 510/284 |
| 6,057,488 A | * | 5/2000 | Koper et al. | 588/200 |
| 6,153,657 A | * | 11/2000 | Kisuno et al. | 516/925 |
| 6,165,939 A | * | 12/2000 | Agbaje et al. | 504/105 |
| 6,245,713 B1 | * | 6/2001 | Brinker | 504/206 |

FOREIGN PATENT DOCUMENTS

| | | | |
|---|---|---|---|
| EP | 875557 | 11/1998 | C11D/3/37 |

* cited by examiner

*Primary Examiner*—Gregory Delcotto
(74) *Attorney, Agent, or Firm*—Joel J. Hayashida

(57) ABSTRACT

An oil-in-water suspoemulsion system is provided for the delivery of actives for laundering, cleaning or surface treatment, in which the suspoemulsion includes a major portion of water as a continuous phase, at least one Active, and an encapsulate including an oil, and at least first and second nonionic surfactants, the first and second nonionic surfactants having a HLB of at least about 3, the encapsulate substantially completely coating the active and suspending it within the aqueous phase.

7 Claims, 1 Drawing Sheet

SUSPOEMULSION SYSTEM FOR DELIVERY OF ACTIVES

RELATED APPLICATIONS

This is a continuation-in-part of provisional application No. 60/139,904, filed Jun. 17, 1999, and of U.S. patent application Ser. No. 09/427,140, filed Oct. 25, 1999, both of which are incorporated herein by reference thereto, which is a continuation-in-part of Ser. No. 08/731,653, filed Oct. 17, 1996, now U.S. Pat. No. 5,972,876.

BACKGROUND OF THE INVENTION

1. Field of the Invention

The invention relates to an oil-in-water suspoemulsion, the suspoemulsion comprising a major portion of water as a continuous phase, at least one water insoluble active, and an encapsulate comprising an oil, at least first and second nonionic surfactants, the first and second nonionic surfactants having a HLB of at least about 3. The encapsulate either protects the active from premature dispersion, activation or reaction, allows a greater loading of the active into the suspoemulsion compared with prior systems, protects the container for the suspoemulsion from the active, or a combination of the foregoing.

2. Brief Statement of the Related Art

A suspoemulsion is an oil-in-water emulsion which has been previously described in the art in the context of delivery systems for agricultural chemicals, such as herbicides and pesticides. See, e.gs., Frisch et al., U.S. Pat. Nos. 5,074,905 and 4,853,026, and Dookhith et al., U.S. Pat. No. 5,096,711. The use of suspoemulsion has not, however, been disclosed, taught or suggested for use in delivering cleaning, laundering or household surface treatment products.

Additionally, EP 875557 (Rohm and Haas) discloses a thickening system for an aqueous composition in which two surfactants differ in their HLB characteristics by at least 1.0, most preferably 6.0 units, and which are combined with a hydrophobically-modified polymer associative thickener. The thickening systems are apparently produced in advance of addition to aqueous formulations, resulting in a solvated "surfactant-thickener matrix" (page 8, line 47), which, when added to an aqueous formulation, results in a thickened reticulum throughout the aqueous formulation, allowing the suspension of various actives throughout the formulation because it has been so thickened. And, although these formulations are described as including cosmetic and personal care formulations and cleaning formulations (See page 13, lines 30–49), it is clear that the target executions of this invention are primarily coating compositions, such as paints and stains, where thickening of the formulations are crucial to prevent sagging and to facilitate leveling on surfaces to which the formulations are applied.

On the other hand, various efforts to protect sensitive actives in liquid, aqueous cleaning or laundering formulations have also been heretofore described. For example, in Haendler, U.S. Pat. Nos. 5,075,029 and 4,929,383, a liquid hypochlorite bleach contains actives, such as ultramarine blue (UMB), which are suspended in a latex reticulum to prevent premature release into wash water and premature oxidation by the hypochlorite in which the UMB is suspended. The latex reticulum is described as having a lipophilic phase for polymer droplets of submicron size. However, this latex reticulum is composed of either oxidized polyethylene, polyethylene-acrylic acid copolymer, or mixtures thereof, which differ markedly from the surfactant encapsules of the invention.

Further, in Koerner et al., U.S. Pat. No. 5,589,448 and Sells et al., U.S. Pat. No. 5789,394, hydrolytic enzymes, common ingredients in cleaning formulations, have been suspended in a structured liquid comprising two different surfactants having a first HLB of greater than about 11 and a second having an HLB of less than or equal to 11, the difference in HLB values between the first and second surfactant exceeding about 2. Pointedly, in both references, hydrotropes, organic solvents and surfactants other than nonionic surfactants cannot be present or disruption of the structured liquid matrix in the liquid composition will occurs, resulting in a loss in enzyme stability

SUMMARY AND OBJECTS OF THE INVENTION

The invention provides an oil-in-water suspoemulsion system for the delivery of actives for laundering, cleaning or surface treatment, the suspoemulsion comprising a major portion of water as a continuous phase, at least one water insoluble active, and an encapsulate comprising an oil, at least first and second nonionic surfactants, the first and second nonionic surfactants having a HLB of at least about 3, the encapsulate substantially completely coating the active and suspending it within the aqueous phase.

It is therefore an object of this invention to provide an oil-in-water suspoemulsion for the delivery of actives for laundering, cleaning or surface treatment, the release of actives typically occurring in an aqueous wash water, or by application to a surface, with abrading action.

It is a further object of this invention to provide in the suspoemulsion an encapsulated active, which either protects the active from premature dispersion, activation or reaction, allows a greater loading of the active into the suspoemulsion compared with prior systems, protects the container for the suspoemulsion from the active, or a combination of the foregoing.

It is also an object of this invention to provide a suspoemulsion formulation which can deliver a cleaning, oxidizing, fragrancing, antimicrobial, fabric softening, brightening, shining, restorative, anti-staining or other functional or aesthetic performance.

DETAILED DESCRIPTION OF THE INVENTION

Figure 1:
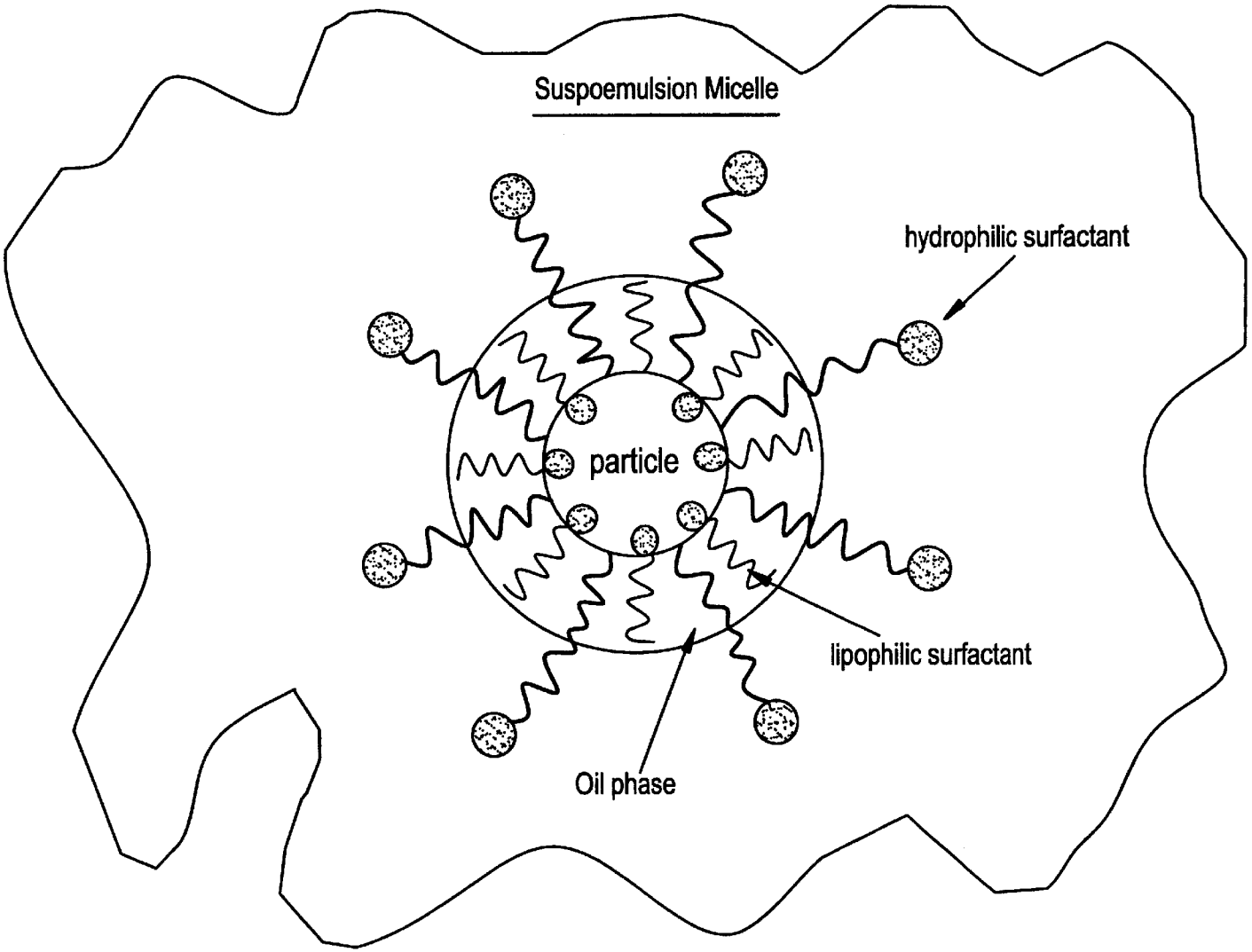
FIG. 1 is an illustration of the formation of an encapsulated active in the inventive suspoemulsion composition.

The invention provides an oil-in-water suspoemulsion system for the delivery of actives for laundering, cleaning or surface treatment, the suspoemulsion comprising a major portion of water as a continuous phase, at least one water insoluble active, and an encapsulate comprising an oil, and at least first and second nonionic surfactants, the first and second nonionic surfactants having a HLB of at least about 3, the encapsulate substantially completely coating the active and suspending it within the aqueous phase.

Standard, additional cleaning, laundering, or surface treatment adjuncts in small amounts such as fragrance, dye, mildewstat/bacteristat, antimicrobial, and the like can be included to provide desirable attributes of such adjuncts.

In the application, effective amounts are generally those amounts listed as the ranges or levels of ingredients in the descriptions which follow here to. Unless otherwise stated, amounts listed in percentage ("%'s") are in weight percent of the composition, unless otherwise noted.

1. The Active

The Active is defined as a generally water insoluble material, such as an abrasive or other material which provides a functional or aesthetic benefit in a washing, cleaning or surface treatment product; or a material which is water soluble but which is desirable to prevent immediate contact with water so as to prevent premature reaction, such as hypochlorite; or is desired to be retained during a process, such as laundering, to deliver the Active at the end of the process, such as a santizer/antimicrobial agent; or is desired to be present in relatively high quantity in a liquid with which the Active is not miscible or is poorly miscible, such as increasing the amount of abrasive, builder, or oil soluble material in an aqueous composition. In the last case, it is well known that materials which are not water soluble or which are solids tend to phase separate from the aqueous phase, leading to visibly disparate layers, which is deemed undesirable, from both performance and aesthetic perspectives.

Various desirable Actives include:

a. Abrasives, such as finely divided silica, titanium dioxide, ultramarine blue, calcium carbonate; water soluble abrasives such as sodium bicarbonate, borax pentahydrate and decahydrate; and organic abrasives. Finely divided silica is especially desirable, with a preferred material being Sident, from Degussa Corp. It is preferred that the abrasive have a particle size of less than 200, and especially, less than 50. This particular fine size is easier to incorporate as a payload in the suspoemulsion and is easier to dispense from a trigger sprayer, which has a relatively small spray orifice. Most liquid abrasive cleaners are pourable, necessitated by the relatively larger particle size of the abrasives, as well as the fact that most other commercial liquid cleaners have a tendency to thicken, which, in a trigger sprayer, would lead to clogging. As well, the inventive suspoemulsions can carry larger amounts of abrasives, indeed, other types of solids, relative to prior liquid compositions (in the form of suspensions, dispersions, mulls, or other forms) without phase separation, which is distinctly advantageous.

b. Antimicrobial actives, such as, without limitation, quaternary ammonium compounds, "polyquats," which are reaction products/mixtures of anionic polymer or prepolymers with quaternary ammonium compounds, phenols, 3-isothiazolones, methyl and propyl parabens, triclosan, and the like, are advantageously delivered via the inventive suspoemulsions. These antimicrobial materials are desired to be delivered to a particular surface, such as in laundering fabrics, or in hard surface treatment, so as to deliver residual antimicrobial activity. Exemplary antimicrobials include BTC 885 and Barquat MB-50, $C_{14}$ alkylbenzyldimethylammonium chloride (50% solution), available from Stepan and Lonza, respectively. Especially preferred are the polyquats which are referred to in Zhou, U.S. Pat. No. 6,017,561, and Zhou et al., U.S. patent application Ser. No. 09/116,190, filed Jul. 15, 1998, both of common assignment, and incorporated herein by reference thereto.

c. Fragrances, which are usually lipophilic oils, such as, without limitation, materials which can also function as solvents, such as terpenes and their derivatives, Representative examples for each of the above classes of terpenes with functional groups include but are not limited to the following: Terpene alcohols, including, for example, cis-2-pinanol, pinanol, thymol, 1,8-terpin, dihydro-terpineol, tetrahydromyrcenol, tetrahydrolinalool, and tetrahydro-alloocimenol; and terpene ethers, including, for example, benzyl isoamyl ether, 1,8-cineole, 1,4-cineole, isobornyl methylether, methyl hexylether. Further, other tertiary alcohols are useful herein. Additional useful solvents include alicyclic hydrocarbons, such as methylcyclohexane. Terpene hydrocarbons with functional groups which appear suitable for use in the present invention are discussed in substantially greater detail by Simonsen and Ross, *The Terpenes,* Volumes I–V, Cambridge University Press, 2nd Ed., 1947 (incorporated herein by reference thereto). See also, co-pending and commonly assigned U.S. Pat. No. 5,279,758, of Choy, incorporated herein by reference thereto. Other fragrances are found amongst combinations of aldehydes, esters, essential oils, and the like. See, Bertrand et al., U.S. Pat. No. 4,938,416, and Swatling et al, U.S. Pat. No. 5,227,366, both of which are incorporated herein by reference.

d. Hypochlorite-generating compounds, such as selected from the group consisting of the alkali metal and alkaline earth salts of hypohalite, haloamines, haloimines, haloimides and haloamides. Representative hypochlorite-producing compounds include sodium, potassium, lithium and calcium hypochlorite, chlorinated trisodium phosphate dodecahydrate, potassium and sodium dicholoroisocyanurate and trichlorocyanuric acid. In addition, the transition metal salts of chloroisocyanuric acid, such as Cu(I and II), Zn, Fe (I and II), Cr and the like, are especially preferred. Organic bleach sources suitable for use include heterocyclic N-bromo and N-chloro imides such as trichlorocyanuric and tribromocyanuric acid, dibromo and dichlorocyanuric acid, and potassium and sodium salts thereof, N-brominated and N-chlorinated succinimide, malonimide, phthalimide and naphthalimide. Also suitable are hydantoins, such as dibromo and dichlorodimethylhydantoin, chlorobromodimethylhydantoin, N-chlorosulfamide (haloamide) and chloramine (haloamine). Hydantoins and/or chloroisocyanurates are particularly preferred since they are solids, readily available and cost-effective. Suitable manufacturers include Olin, and Lonza.

e. Fabric Softeners, such as, without limitation, di-short chain ($C_{1-3}$), di-long chain ($C_{10-30}$)alkyl quaternary ammonium salts (with a wide variety of counterions, including, but not limited to, halide, especially, chloride, methosulfate, nitrates, etc.), alkyl imidazolinium salts (with similar counterions), other cationic fabric softeners, and mixtures thereof. See also, MacGilp et al., U.S. Pat. No. 4,454,049, and UK 2,007,734, both of which are incorporated herein by reference. In addition, $C_{6-24}$ alkyl carboxylates, or soaps, can themselves confer a softening effect on garments washed therewith.

f. Fluorescent whitening agents, or optical brighteners, are preferred laundry product adjuncts, and are fluorescent materials which fluoresce by absorbing ultraviolet wavelength light and emitting visible light, generally in the color blue wavelength ranges. The whiteners settle out or deposit onto fabrics during the washing cycle. Exemplary such materials are stilbene and styrylnapthalene derivatives. See also, Mitchell et al., U.S. Pat. No. 4,900,468, column 5, line 66 to column 6, line 27, incorporated herein by reference.

g. Shining, restorative or anti-filming agents are generally polymers, especially those that will lay down a coating or residue to a surface treated therewith such as to confer shine, dimensional stabilization or finish, or prevent re-soiling or other such surface protection/modification. Examples of such materials include a water soluble to dispersible polymer having a molecular weight of generally below 2,000,000 daltons. The polymers will also be not damaging to fabrics, carpets, and other soft surfaces. They should have enough tack or stickiness, when applied and dried, to provide a matrix in which the malodor may be entrapped, but not so much that to the human touch the film or residue feels or imparts an obvious sticky feel. Preferably, the polymer will also not itself have an obvious or offensive odor, although that attribute can be mitigated by judicious selection of fragrance.

Examples of suitable classes of polymers include:

i. Fluoropolymers

As mentioned above, the fluoropolymers used in the invention are those which have a molecular weight of at least about 5,000 Daltons, more preferably at least about 10,000 Daltons. In fact, some of the polymers considered useful herein may have molecular weights upwards of 300,000 Daltons. The fluoropolymers can be at least partially substituted with water solubilizing groups, such as, without limitation, carboxyl, amido, sulfonato, ethoxyl, propoxyl and the like. It is thus preferred that the fluoropolymers be at least water-dispersible, and preferably, are at least sparingly water-soluble. These types of fluoropolymers include fluorinated substituted urethanes (such as Zonyl® 7910 from E. I. du Pont de Nemour and Co., hereinafter, "DuPont"), and perfluoroalkylmethacrylic copolymers (such as such as Zonyl® 8740 from DuPont, and Zonyl 9027, also from DuPont.

ii Polysaccharides

Suitable polymers may comprise polysaccharide polymers, which include substituted cellulose materials like carboxymethylcellulose, ethyl cellulose, hydroxyethylcellulose, hydroxypropylcellulose, hydroxymethylcellulose, succinoglycan and naturally occurring polysaccharide polymers like xanthan gum, guar gum, locust bean gum, tragacanth gum or derivatives thereof. Particularly useful polysaccharides are xanthan gum and derivatives thereof. Some of these are thickeners which may have too much tack, from a performance and aesthetic standpoint. Additional suitable polysaccharide polymers may include sodium caseinate and gelatin. Other suitable polysaccharide polymers may include cationic derivatives, such as the cationic cellulose ether, Polymer JR.

iii. Polycarboxylates

Polycarboxylates can also be used which contain amounts of nonionizable monomers, such as ethylene and other simple olefins, styrene, alpha-methylstyrene, methyl, ethyl and $C_3$ to $C_8$ alkyl acrylates and methacrylates, isobornyl methacrylate, acrylamide, hydroxyethyl acrylate and methacrylate, hydroxypropyl acrylate and methacrylate, N-vinyl pyrrolidone, butadiene, isoprene, vinyl halides such as vinyl chloride and vinylidine chloride, alkyl maleates, alkyl fumarates. Other suitable polymers include other polycarboxylates, such as homopolymers and copolymers of monomeric units selected from the group consisting of unsaturated carboxylic acids such as acrylic acid, methacrylic acid, polycarboxylic acids, sulfonic acids, phosphonic acids and mixtures thereof Copolymerization of the above monomeric units among them or with other co-monomers such as maleic anhydride, ethylene or propylene are also suitable.

iv. Polystyrenesulfonates

Other suitable polymers are polystyrenesulfonates such as Flexan 130 and Versa TL501 from National Starch and Chemical. Polystyrenesulfonates are also useful as copolymers, for example Versa TL-4 also from National Starch and Chemical.

v. Acrylate Polymers

Other suitable polymers are acrylic emulsion polymers used as floor polish coatings. These are generally copolymers of one or more acidic monomers, such as acrylic acid, methacrylic acid or maleic anhydride, with at least one other ethylenically unsaturated monomer selected from a group consisting of ethylene and other simple olefins, styrene, alpha-methylstyrene, methyl, ethyl and $C_3$ to $C_8$ alkyl acrylates and methacrylates, isobornyl methacrylate, acrylamide, hydroxyethyl acrylate and methacrylate, hydroxypropyl acrylate and methacrylate, N-vinyl pyrrolidone, butadiene, isoprene, vinyl halides such as vinyl chloride and vinylidine chloride, alkyl maleates, alkyl fumarates, fumaric acid, maleic acid, itaconic acid, and the like. It is also frequently desirable to include minor amounts of other functional monomers, such as acetoacetoxy methacrylate or other acetoacetate monomers and divinyl or polyvinyl monomers, such as glycol polyacrylates, allyl methacrylate, divinyl benzene and the like. The preferred polymers have an acid number from about 75 to about 500 and a number average molecular weight of about 500 to about 20,000. These polymers may also be crosslinked with metal ions or modified for crosslinking with silane functionality as described, for example, in U.S. Pat. No. 5,428,107. Examples of such acrylic emulsion polymers include those available under the Rhoplex tradename from Rohm & Haas, such as Rhoplex AC-33, Rhoplex B-924, and Rhoplex MC-76. There are also polymers from National Starch and Chemical, such as Amaze, Flexan and Balance CR, Balance 47 and Balance 055. Other preferred polymers are Carboset GA 233, EX561 and 2123, all by B. F. Goodrich. Other suitable polymers are copolymers of acrylic and/or methacrylic acid with acrylate and methacrylate esters. For example, a copolymer of 51% methyl methacrylate, 31% butyl acrylate, and 18% acrylic acid is available from Rohm & Haas as Emulsion Polymer E-1250. Additionally, there are acrylates from Rohm and Haas, namely, Acusol, such as Acusol 445, and the like. See also Keyes et al., U.S. Pat. No. 4,606,842, incorporated herein by reference.

Other suitable polymers may include cationic acrylic water soluble polymers that are copolymers of cationic quaternized acrylates, methacrylates, acrylamides, and methacrylamides, for example trimethylammoniumpropylmethacrylate, and acrylamide or acrylonitrile.

vi. Polyethyleneimines

Other suitable polymers are polyethyleneimines and copolymers with other polyalkyleneimines. These amino-functional polymers can also be modified by ethoxylation and propoxylation. These amino-functional polymers can also be quanternized with methyl groups or oxidized to amine oxides.

vii. Polyvinylpyrrolidones

Other suitable polymers include vinylpyrrolidone homopolymers and copolymers. Suitable vinylpyrrolidone homopolymers have an average molecular weight of from 1,000 to 100,000,000, preferably from 2,000 to 10,000,000, more preferably from 5,000 to 1,000,000, and most preferably from 30,000 to 700,000. Suitable vinyl pyrrolidone homopolymers are commercially available from ISP Corporation, Wayne, N.J. under the product names PVP K-15 (average molecular weight of 8,000), PVP K30 (average molecular weight of 38,000), PVP K-60 (average molecular weight of 216,000), PVP K-90 (average molecular weight of 630,000), and PVP K-120 (average molecular weight of 2,900,000). Suitable copolymers of vinylpyrrolidone include copolymers of N-vinylpyrrolidone with one or more alkylenically unsaturated monomers. Suitable alkylenically unsaturated monomers include unsaturated dicarboxylic acids such as maleic acid, chloromaleic acid, fumaric acid, itaconic acid, citraconic acid, phenylmaleic acid, aconitic acid, acrylic acid, methacrylic acid, N-vinylimidazole, vinylcaprolactam, butene, hexadecene, and vinyl acetate. Any of the esters and amides of the unsaturated acids may be employed, for example, methyl acrylate, ethylacrylate, acrylamide, methacryamide, dimethylaminoethylmethacrylate, dimethylaminopropylmethacrylamide, trimethylammoniumethylmethacrylate, and trimethylammoniumpropylmethacrylamide. Other suitable alkylenically unsaturated monomers include aromatic monomers such as styrene, sulphonated styrene, alpha-methylstyrene, vinyltoluene, t-butylstyrene and others. Copolymers of vinyl-pyrrolidone with vinyl acetate are commercially available under the trade name PVP/VA from ISP Corporation. Copolymers of vinylpyrrolidone with alpha-olefins are available, for example, as P-904 from ISP Corporation. Copolymers of vinylpyrrolidone with dimethylaminoethylmethacrylate are available, for example, as Copolymer 958 from ISP Corporation. Copolymers of vinylpyrrolidone with trimethylammoniumethylmethacrylate are available, for example, as Gafquat 734 from ISP Corporation. Copolymers of vinylpyrrolidone with trimethyl-ammonium-propylmethacrylamide are available, for example, as Gafquat HS-100 from ISP Corporation. Copolymers of vinylpyrrolidone with styrene are available, for example, as Polectron 430 from ISP Corporation. Copolymers of vinylpyrrolidone with acrylic acid are available, for example, as Polymer ACP 1005 (25% vinylpyrrolidone/75% acrylic acid) from ISP Corporation.

viii. Methylvinyl ether

Other suitable polymers include methylvinylether homopolymers and copolymers. Preferred copolymers are those with maleic anhydride. These copolymers can be hydrolyzed to the diacid or derivatized as the monoalkyl ester. For example, the n-butyl ester is available as Gantrez ES-425 from ISP Corporation.

ix. Polyvinyl alcohols

Other suitable polymers include polyvinyl alcohols. Preferably, polyvinyl alcohols which are at least 80.0%, preferably 88–99.9%, and most preferably 99.0–99.8% hydrolyzed are used. For example, the polyvinyl alcohol, Elvanol 71–30 is available from E. I. DuPont de Nemours and Company, Wilmington, Del.

x. Polyethylene glycols

Yet other feasible polymers may be polyethylene glycols, such as disclosed in Baker et al., U.S. Pat. No. 4,690,779, incorporated herein by reference.

Mixtures of any of the foregoing polymers may be possible or desirable.

h. Nanoparticles, which are solids having an average particle size of between 1 and 1,000 nanometers ("nm"), have unique properties which may include cleansing, antimicrobial/antiviral action, decontamination, and the like (See, Koper et al., U.S. Pat. No. 6,057,488, incorporated herein by reference), appear also to be suitable for inclusion as the Active.

The amount of Active that can be suspended in the novel suspoemulsions of this invention appears to vary from about 0.01 to about 50% by weight of the composition, more preferably 0.1 to about 40%, and most preferably, about 0.1 to about 35%.

The foregoing list of Actives is meant to be illustrative and non-limitative.

2. The Oil Phase a. The Oil. The oil phase comprises an oil which is a lipophilic constituent, which is then combined with nonionic surfactants which will have a HLB of at least about 3. The oil phase is generally adsorbed/absorbed onto the surface of the active.

The oils include hydrocarbons with a carbon chain length of at least 10, preferably at least 12, preferably, which do not have a distinctive odor, glycerides, and the like, such as isoparaffinic materials, terpene compounds (including terpene hydrocarbons, such d-limonene), seed oils and their derivatives (such as soybean oil, sunflower oil, canola, partially hydrogenated cottonseed, corn, olive and other oils), silicone oils (e.g., cyclic and linear silicone fluids, such as, without limitation, Dow 245 and Dow 246, which are, respectively, 5 and 6 member cyclic silicones, from Dow Chemical Co.), mineral oil and castor oil (triglyceride of ricinoleic acid). Preferably, the oils are thickened, so as to improve the ease of blending. A preferred oil is Versagel M200, from Penrico. This mineral oil may be modified by a proprietary polymer blend. Other types of co-thickeners include finely divided silica, such as Aerosil (particle size of about 1 4 nm), xanthan gum, guar gum (galactomannan) and other naturally occurring gums. In the practice of the invention, it is believed that the oil coats the Active, by adsorption, absorption, or some other physical force, so as to prevent or mitigate contact with the aqueous phase. The surfactants thereafter help to suspend the oil phase uniformly throughout the aqueous phase. Reference is now made to the Drawing, FIG. 1, in which the particle is the Active, and the Oil phase comprises the oil, which, aided by the more lipophilic surfactant(s), encapsulates or coats the Active. In addition, the combined surfactants stably suspend the Active in the aqueous phase.

The physical properties of the suspoemulsion provide excellent advantages for the uses contemplated herein, for example, for cleaning, laundering, and surface treatment. The suspoemulsion is quite durable, and so, in some instances, to deliver the "payload," i.e., to release the Active, mechanical action, such as abrading or rubbing against a surface, is sometimes required. Further, the suspoemulsion is quite durable and can withstand elevated temperatures and times, indicating long term storage stability.

b. The Nonionic surfactants:

The nonionic surfactants used in the suspoemulsion to help suspend the Actives and to help the Oil Phase are at least a first and a second nonionic surfactant which have a HLB of at least about 3. For a further discussion of HLB measurements, one should consult Popiel, *Introduction to Colloid Science* (1978), pp. 43–44 and Gerhartz, *Ullmann's Encyclopedia of Industrial Chemistry,* 5th Ed., Vol. A9 (1985), pp. 322–23, both of which are incorporated by reference thereto.

The first nonionic surfactant has an HLB of about less than 7, while the second has an HLB of about greater than 10. It is preferable to include a third surfactant which has a midrange HLB, of about 8–9. The preferred surfactants are block copolymers of ethylene and propylene oxide, available from Rohm and Haas under the trademark Pluronic. These are depicted in the "Pluronic Grid," published by BASF on their website http//www.basf.com/businesses/, which is incorporated herein by reference thereto. It has been found that a combination of Pluronics with HLB of 13, one of HLB 6 and one of HLB 8, has been especially beneficial in the invention. Exemplary such surfactants include Pluronic P104, L92 and 25R4.

Other surfactants which could supplement, or possibly substitute, for the foregoing nonionic surfactants may be selected from linear and branched alkoxylated alcohols and alkoxylated alkylphenols. The alkoxylated alcohols include ethoxylated, propoxylated, and ethoxylated and propoxylated $C_{5-20}$ alcohols, with about 1–5 moles of ethylene oxide, or about 1–5 moles of propylene oxide, or 1–5 and 1–5 moles of ethylene oxide and propylene oxide, respectively, per mole of alcohol. There are a wide variety of products from numerous manufacturers, such as the Neodol series from Texaco Chemical Co., to wit, Neodol 25-3, a linear $C_{12-15}$ alcohol ethoxylate with 3 moles of ethylene oxide ("EO") per mole of alcohol, HLB of 7.8, and Neodol 91-2.5,a linear $C_{9-11}$ alcohol ethoxylate with 2.5 moles of EO; Alfonic 1412-40, a $C_{12-14}$ ethoxylated alcohol with 3 moles of EO from Conoco; Surfonic L12-2.6, a $C_{10-12}$ ethoxylated alcohol with 3 moles of EO, and Surfonic L24-3, a $C_{12-14}$ ethoxylated alcohol with 3 moles of EO from Huntsman Chemical; and Tergitol 25-L-3, a $C_{12-15}$ ethoxylated alcohol with 3 moles of EO, from Union Carbide. The secondary ethoxylated alcohols include Tergitol 15-S-3, a $C_{11-15}$ secondary ethoxylated alcohol, with 3 moles of EO, from Union Carbide. The branched surfactants, especially preferred of which are tridecyl ethers, include Trycol TDA-3, a tridecyl ether with 3 moles of EO, from Henkel KGaA (formerly, Emery), and Macol TD 3, a tridecyl ether with 3 moles of EO, from PPG Industries. See, also, *McCutcheon's Emulsifiers and Detergents,* 1987. The sparingly soluble nonionic surfactant can also be selected from alkoxylated alkylphenols, such as: Macol NP-4, an ethoxylated nonylphenol with 4 moles of EO, and an HLB of 8.8, from PPG; Triton N-57, an ethoxylated nonylphenol with an HLB of 10.0, Triton N-42, an ethoxylated nonylphenol with an HLB of 9. 1, both from Rohm & Haas Co.; and Igepal CO-520, with an HLB of 10.0, an ethoxylated nonylphenol from GAF Chemicals Corp.; Alkasurf NP-5, with an HLB of 10.0, and Alkasurf NP-4, with an HLB of 9.0, both of which are ethoxylated nonylphenols from Alkaril Chemicals; Surfonic N-40, with an HLB of 8.9, an ethoxylated nonylphenol from Huntsman. See, *McCutcheon's Emulsifiers and Detergents* (1987), especially page 282, incorporated herein by reference thereto. The nonionic surfactant can be chosen from, among others: Alfonic surfactants, sold by Conoco, such as Alfonic 1412-60, a $C_{12-14}$ ethoxylated alcohol with 7 moles of EO; Neodol surfactants, sold by Shell Chemical Company, such as Neodol 25-7, a $C_{12-15}$ ethoxylated alcohol with 7 moles of EO, Neodol 45-7, a $C_{14-15}$ ethoxylated alcohol with 7 moles of EO, Neodol 23-5, a linear $C_{12-13}$ alcohol ethoxylate with 5 moles of EO, HLB of 10.7; Surfonic surfactants, also sold by Huntsman Chemical Company, such as Surfonic L12-6, a $C_{10-12}$ ethoxylated alcohol with 6 moles of EO and L24-7, a $C_{12-14}$ ethoxylated alcohol with 7 moles of EO; and Tergitol surfactants, both sold by Union Carbide, such as Tergitol 25-L-7, a $C_{12-15}$ ethoxylated alcohol with 7 moles of EO. Macol NP-6, an ethoxylated nonylphenol with 6 moles of EO, and an HLB of 10.8, Macol NP-9.5, an ethoxylated nonylphenol with about 11 moles EO and an HLB of 14.2, Macol NP-9.5, an ethoxylated nonylphenol with about 9.5 moles EO and an HLB of 13.0, both from Mazer Chemicals, Inc.; Triton N-101, an ethoxylated nonylphenol with 9–10 moles of ethylene oxide per mole of alcohol ("EO") having a hydrophile-lipophile balance ("HLB") of 13.4, Triton N-111, an ethoxylated nonylphenol with an HLB of 13.8, both from Rohm & Haas Co.; Igepal CO-530, with an HLB of 10.8, Igepal CO-730, with an HLB of 15.0, Igepal CO-720, with an HLB of 14.2, Igepal CO-710, with an HLB of 13.6, Igepal CO-660, with an HLB of 13.2, Igepal CO-620, with an HLB of 12.6, and Igepal CO-610 with an HLB of 12.2, all polyethoxylated nonylphenols from GAF Chemicals Corp.; Alkasurf NP-6, with an HLB of 11.0, Alkasurf NP-15, with an HLB of 15, Alkasurf NP-12, with an HLB of 13.9, Alkasurf NP-11, with an HLB of 13.8, Alkasurf NP-10, with an HLB of 13.5, Alkasurf NP-9, with an HLB of 13.4, and Alkasurf NP-8, with an HLB of 12.0, all polyethoxylated nonylphenols from Alkaril Chemicals; and Surfonic N-60, with an HLB of 10.9, and Surfonic N-120, with an HLB of 14.1, Surfonic N-102, with an HLB of 13.5, Surfonic N-100, with an HLB of 13.3, Surfonic N-95, with an HLB of 12.9, and Surfonic N-85, with an HLB of 12.4, all polyethoxylated nonylphenols from Huntsman.

The amount of the nonionic surfactants is generally between about 0.1 to about 30%, of the aqueous composition. On the other hand, the ratio between the nonionic surfactants, if there are two, should be at least greater than 1:1, more preferably between about 50:1 to 0.9:1, the HLB of greater than 10 with respect to the HLB less than 7, most preferably between about 25:1 to about 3:1. If there is a third, mid-HLB surfactant, then the relationship should be about 50:25:1 to about 0.9:1:1.

3. Water

The third principal ingredient is water, which should be present at a level of at least about 50%, more preferably at least about 60%, and most preferably, at least about 70%. Deionized water is most preferred. Water forms the predominant, continuous phase in which the oil phase is dispersed.

4. Miscellaneous Adjuncts

Small amounts of adjuncts can be added for improving aesthetic or functional qualities of the invention. Also, those materials below are optional and not to be considered to overlap with the already mentioned Actives in 1. above. Aesthetic adjuncts include fragrances, such as those available from Givaudan-Rohre, International Flavors and Fragrances, Firmenich, Norda, Bush Boake and Allen, Quest and others, and dyes and colorants which can be solubilized or suspended in the formulation. A wide variety of dyes or colorants can be used to impart an aesthetically and commercially pleasing appearance. Also, advantageously, the fragrance oils do not require a dispersant since the oil phase will act to disperse limited solubility oils. The amounts of these aesthetic adjuncts should be in the range of 0–2%, more preferably 0–1%. In terms of functional adjuncts, firstly, because the surfactants in liquid systems are sometimes subject to attack from microorganisms, it is advantageous to add a mildewstat or bacteristat. Exemplary mildewstats (including non-isothiazolone compounds) include Kathon GC, a 5-chloro-2-methyl-4-isothiazolin-3-one, Kathon ICP, a 2-methyl-4-isothiazolin-3-one, and a blend thereof, and Kathon 886, a 5-chloro-2-methyl-4-isothiazolin-3-one, all available from Rohm and Haas Company; Bronopol, a 2-bromo-2-nitropropane 1,3-diol, from Boots Company Ltd.; Proxel CRL, a propyl-p-hydroxybenzoate, from ICI PLC; Nipasol M, an o-phenylphenol, $Na^+$ salt, from Nipa Laboratories Ltd.; Dowicide A, a 1,2-benzoisothiazolin-3-one, from Dow Chemical Co.; and Irgasan DP 200, a 2,4,4'-trichloro-2-hydroxydiphenylether, from Ciba-Geigy A. G. See also, Lewis et al., U.S. Pat. Nos. 4,252,694 and 4,105,431, incorporated herein by reference. Other desirable solids may include salts (such as NaCl, $Na_2SO_4$), builders, electrolytes, enzymes, chelating agents (without limitation, such as alkali metal salts of EDTA, preferably tetrapotassium EDTA; See Robbins et al., U.S. Pat. No. 5,972,876, incorporated herein by reference; or tetraammonium EDTA see Mills et al., U.S. Pat. Nos. 5,814,591 and 6,004,916, incorporated herein by reference) salts, pigments, and the like. Additional surfactants (anionic, nonionic, cationic, amphoteric, zwitterionic and mixtures), hydrotropes, solvents, and other dispersing aids may also be added in discrete amounts, taking into account their individual performance attributes and whether their addition may affect the suspoemulsion.

5. The Preferred Method of Addition

In order to best practice the invention, the oil phase and the aqueous phase materials are separately prepared, with the Active being added to the oil phase, or being separately added. The, the two phases are combined, by means of high shear, using a variable high speed mixer, with a rotary speed of at least 2,000 rpm. Apparently, in order to blend or cause the emulsion to form, a very high rate of shear is needed when the Active is added. It is thus believed, without limitation of theory, that the Active is coated with the oil phase, and that the surfactants then help to maintain an encapsulate around the Active, and also to maintain the stable suspension of the Active within the emulsion, thus resulting in the suspoemulsion and its attendant advantages. A preferred variable high speed mixer is Dispermat, from VMA-Getzmann GmbH, although other apparatuses are suitable for use.

In the following Experimental section, examples of the inventive composition are provided.

EXPERIMENTAL

In the following section, examples of various embodiments of the invention are depicted. Where ingredients are repeated in some of the Examples, and have been previously identified in footnotes in prior Examples, those footnotes are not repeated.

Example I

Sprayable Surface Safe Abrasive Cleaner

| Ingredient | Weight % |
|---|---|
| Abrasive - Silica[1] | 13.00 |
| Co-Thickener - Silica[2] | 0.95 |
| Co-Thickener - Castor Oil[3] | 0.07 |
| Co-Thickener/Adhering Agent[4] | 0.35 |
| Mineral Oil | 13.00 |
| $K_4$EDTA[5] | 4.50 |
| Nonionic Surfactant[6] - HLB 13 | 1.00 |
| Nonionic Surfactant[7] - HLB 6 | 5.00 |
| Nonionic Surfactant[8] - HLB 8 | 2.00 |
| Semi-Polar Nonionic Surfactant[9] | 1.67 |
| Water (deionized) | q.s. |
| Total: | 100.00% |

[1]Sident 9, Degussa Corp. (particle size 50)
[2]Aerosil R-972, Degussa Corp. (particle size~14 nm)
[3]Triglyeride of Castor Oil, Rheox
[4]Xanthan Gum, Kelco
[5]Chelant
[6]Pluronic P104, BASF Corp.
[7]Pluronic L92, BASF Corp.
[8]Pluronic 25R4, BASF Corp.
[9]$C_{12}$amine oxide, Stepan Co.

In the above example, the first two co-thickeners are combined with the mineral oil to form an oil phase, with slow heating to about 50° C./122° F. until fully blended. This first oil phase is allowed to cool to ambient temperature. Next, the first three surfactants are dissolved in a quantity of water, with slow heating to about 50° C./122° F. until fully blended, and this mixture is also allowed to cool. Using a variable high speed mixing apparatus, for example, Dispermat (VMA-Getzmann GmbH) (other potentially useful mixers include Microfluidizer (Arthur D. Little) and apparatuses from Hobart; ball mixers, rollers and other devices may also be suitable), the abrasive is slowly mixed into the water/surfactants mixture at about 4,000 rpm. Thereafter, the last co-thickener/adhering agent is added, slowly. The oil phase mixture is then introduced, at much higher shear, about 8,000 rpm, and processed well. Finally, the last surfactant and the chelating agent are added.

The resulting abrasive liquid cleaner is capable of being dispensed from a trigger sprayer, unlike prior formulations which are too viscous and whose abrasive particle sizes were too large for effective metering from a trigger sprayer.

Example II

Alternative Surface Safe Abrasive Cleaner
An alternative embodiment of a pourable liquid surface safe abrasive cleaner is now presented:

| Ingredient | Weight % |
|---|---|
| Abrasive-Silica | 8.00 |
| Polymer modified Mineral Oil[10] | 8.00 |
| Thickener/Adhering Agent | 0.20 |
| $K_4$EDTA | 5.40 |
| Nonionic Surfactant - HLB 13 | 1.00 |
| Nonionic Surfactant - HLB 6 | 5.00 |
| Nonionic Surfactant - HLB 8 | 2.00 |
| Fragrance[11] | 0.10 |
| Water (deionized) | q.s. |
| Total: | 100.00% |

[10]Versagel M200, polymer-thickened mineral oil, Penrico.
[11]Aesthetic ingredient The above ingredients are combined in the variable high speed mixer, in much the same order and protocol as in Example I.

In the following example, a laundry additive product with residual antimicrobial efficacy is depicted (See also, Zhou, U.S. Pat. No. 6,017,561, and Zhou et al., U.S. patent application Ser. No. 09/116,190, filed Jul. 15, 1998, both of common assignment, and incorporated herein by reference thereto). This type of product is especially desirable because it delivers a long-lasting, antimicrobial active to a targeted surface, in this case, to fabrics washed, or to the internal surface of the washing machine or other apparatus.

Example III

Laundry Additive Produce

| Ingredient | Weight % |
|---|---|
| Polymer modified Mineral Oil | 8.00 |
| Thickener/Adhering Agent | 0.20 |
| Nonionic Surfactant - HLB 13 | 1.00 |
| Nonionic Surfactant - HLB 6 | 5.00 |
| Nonionic Surfactant - HLB 8 | 2.00 |
| Anionic Polymer[12] | 19.80 |
| Quaternary Ammonium Compound[13] | 2.63 |
| Water (deionized) | q.s. |
| Total: | 100.00% |

[12]Acrylic acid polymer, Carboset, from Rohm & Haas
[13]BTC 885, from Stepan Co.

In this formulation, the surfactants are blended with a quantity of water, heated slowly to 50° C./122° F., with stirring. The anionic polymer is then added slowly, with stirring. The quaternary ammonium compound is then blended into the oil phase comprising the polymer modified mineral oil. The variable high speed mixer is then used to blend the thickener/adhering agent within the aqueous phase (water/surfactants) at approximately 4,000–6,000 rpm for a time period not exceeding about 5 minutes. The oil phase is then gradually added at very high shear, about 8,000 rpm, and mixed for about 3–5 minutes further until completely blended.

In the next example, a so-called polyquat is suspended within the suspoemulsion system. The lipid or oil phase is now represented by a silicone fluid.

Example IV

Polyquat Laundry Product

| Ingredient | Weight % |
|---|---|
| Water | 77.49 |
| Cyclic Silicone Fluid[14] | 7.00 |
| Nonionic Surfactant - HLB 13 | 1.00 |
| Nonionic Surfactant - HLB 6 | 5.00 |
| Nonionic Surfactant - HLB 8 | 2.00 |
| Anionic Polymer[15] | 4.77 |
| Fluoropolymer[16] | 1.00 |
| Quaternary Ammonium Compound | 1.39 |
| Thickener[17] | 0.35 |
| Total | 100% |

[14]Dow 246
[15]Carboset GA 233
[16]Zonyl 9027
[17]Xanthan Gum

In this example, the liquid surfactants and water were once again heated and mixed. Then, the polymers were slowly added, with the silicone fluid (oil) and quaternary ammonium compound being weighed out. The mixture was subjected to high shear (above 2,000 rpm), with the thickener thereafter added. The mixture began to thicken and shearing continued to ensure complete mixing. The mixture was then subjected to even higher shear (at least 2× greater), while the oil/quat mixture was added, with final shearing to assure complete mixing. The resulting formulation is referred to as a polyquat suspoemulsion, which delivers both polyquat and a surface modifying polymer, fluoropolymer, as the Actives.

The next examples are for carpet cleaning formulations:

Example V

Carpet Cleaner

| Ingredient | Weight % |
|---|---|
| Water | 66.56 |
| Cyclic Silicone Fluid[18] | 12.00 |
| Nonionic Surfactant - HLB 13 | 1.00 |
| Nonionic Surfactant - HLB 6 | 5.00 |
| Nonionic Surfactant - HLB 8 | 2.00 |
| Thickener | 0.35 |
| Silica Abrasive | 10.00 |
| Borax[19] | 1.00 |
| Organic Solvent[20] | 2.00 |
| Total | 100% |

[18]Dow 245
[19]Buffer
[20]Ethylene glycol n-butyl ether, Dow EB

Similar to the procedure in Example IV, the ingredients were added in the order listed, except for the oil, which was added next to last. The solvent was the last added ingredient.

Example VI

Carpet Cleaner

In Example VI, a different solvent, propylene glycol methyl ether (Dow EB) was used, but the same procedure was followed, in which the, solvent was added in the last step.

The invention has been described without limitation of scope or embodiments. The invention is further defined, again, without limitation, by the claims which follow.

What is claimed is:

1. An oil-in-water suspoemulsion system for the delivery of actives for laundering or cleaning, the suspoemulsion comprising at least about 50% by weight water as a continuous phase, from about 0.01 to 50% by weight of at least one Active selected from the group consisting of an abrasive, an antimicrobial agent, a quaternary ammonium compound, fluoropolymers, polysaccharides, polycarboxylates, polystyrenesulfonates, acrylate polymers, polyethyleneimines, polyvinylpyrrolidones, methylvinyl ether, polyvinyl alcohols, and mixtures thereof, an encapsulate comprising an oil selected from the group consisting of hydrocarbons with a carbon chain length of at least 10, glycerides, terpene compounds, seed oils, silicone oils, castor oil, mineral oil, and mixtures thereof, and at least first and second nonionic surfactants, wherein the first nonionic surfactant has an HLB of less than about 7, and the second nonionic surfactant has an HLB of greater than about 10, the encapsulate coating the active and suspending it within the aqueous phase.

2. The oil-in-water suspoemulsion system of claim 1 wherein said Active is an abrasive.

3. The oil-in-water suspoemulsion system of claim 1 wherein said Active is an antimicrobial agent.

4. The oil-in-water suspoemulsion system of claim 1 wherein said polymer is a fluoropolymer.

5. The oil-in-water suspoemulsion system of claim 1 wherein said Active is a quaternary ammonium compound.

6. The oil-in-water suspoemulsion system of claim 1 wherein said Active comprises the combination of a quaternary ammonium compound and a fluoropolymer.

7. The oil-in-water suspoemulsion system of claim 1 further comprising an adjunct selected from the group consisting of: salts, builders, electrolytes, enzymes, chelating agents, fragrances, dyes, colorants, mildewstats, bacteristats, thickeners, additional surfactants, hydrotropes, solvents, and other dispersing aids.

* * * * *